US005546971A

United States Patent [19]

Leonhardt

[11] Patent Number: 5,546,971

[45] Date of Patent: Aug. 20, 1996

[54] FOLDABLE SHELTER

[76] Inventor: William G. Leonhardt, P.O. Box 130, Pickering, Ontario, Canada, L1V 2R4

[21] Appl. No.: 281,104

[22] Filed: Jul. 27, 1994

[30] Foreign Application Priority Data

Jul. 29, 1993 [CA] Canada ..... 2101602

[51] Int. Cl.[6] ..... E04H 15/40; E04H 15/46

[52] U.S. Cl. ..... 135/127; 135/123; 135/128; 135/140; 135/909

[58] Field of Search ..... 135/95, 123, 124, 135/125, 127, 128, 139, 141, 140, 909

[56] References Cited

U.S. PATENT DOCUMENTS

| | | | |
|---|---|---|---|
| 2,036,033 | 3/1936 | Fisher . | |
| 2,190,566 | 2/1940 | Juuan | 135/95 |
| 2,266,853 | 12/1941 | Dabney . | |
| 2,646,057 | 7/1953 | Blanchard . | |
| 2,969,075 | 1/1961 | Girten . | |
| 3,424,178 | 1/1969 | Yoshimiyazari | 135/157 |
| 4,739,784 | 4/1988 | Fast . | |
| 4,852,599 | 8/1989 | McNamara . | |
| 4,930,534 | 6/1990 | Hill . | |
| 5,080,123 | 1/1992 | Stein | 135/115 X |

FOREIGN PATENT DOCUMENTS

| | | | |
|---|---|---|---|
| 1159914 | 7/1958 | France | 135/138 |

*Primary Examiner*—Wynn E. Wood
*Assistant Examiner*—Yvonne Horton-Richardson
*Attorney, Agent, or Firm*—Banner & Allegretti, Ltd.

[57] ABSTRACT

The shelter has a canopy supported by a frame made up of a pair of flexible lateral rods which are held parallel and apart by three horizontal struts. There is provision for disconnecting the struts from the lateral rods so that the frame may be stored compactly when not in use. A pair of upright poles support the upper end of each lateral rod and guys are attached to the lateral rods for bending them into an arcuate shape.

6 Claims, 3 Drawing Sheets

Figure 1
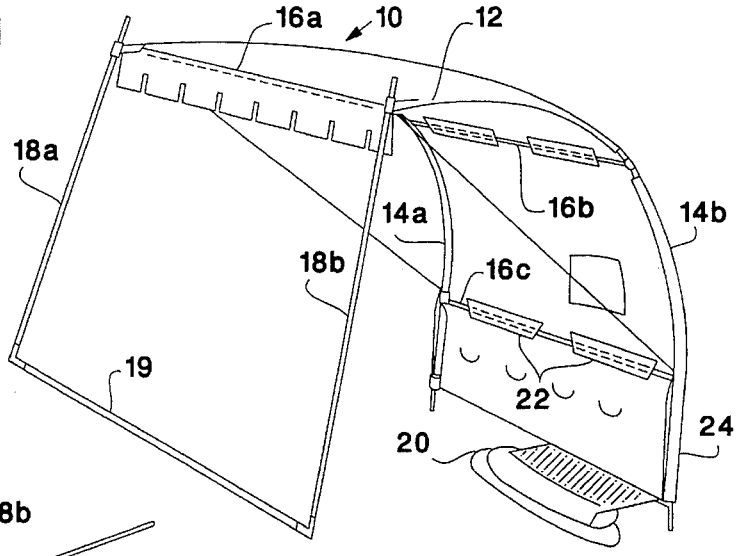
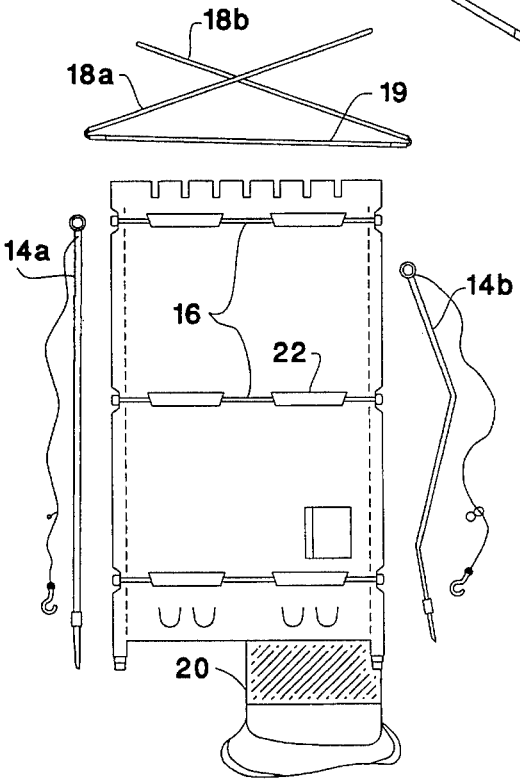
Figure 2
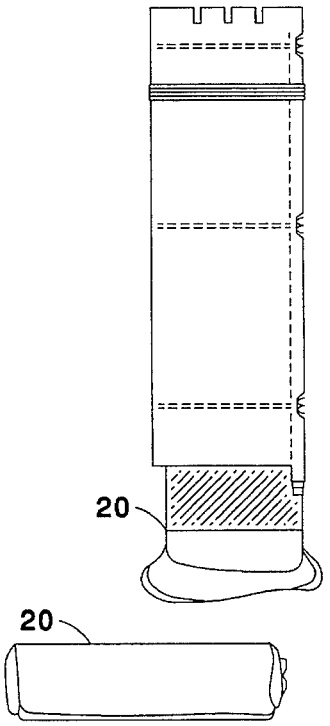
Figure 3
Figure 4

Figure 5
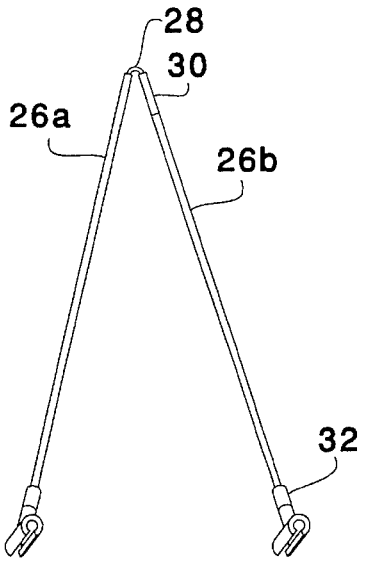
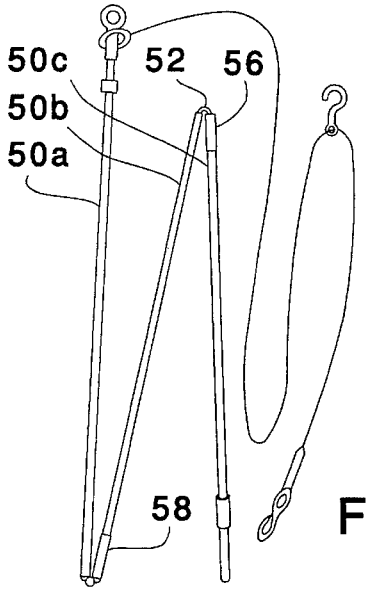
Figure 6
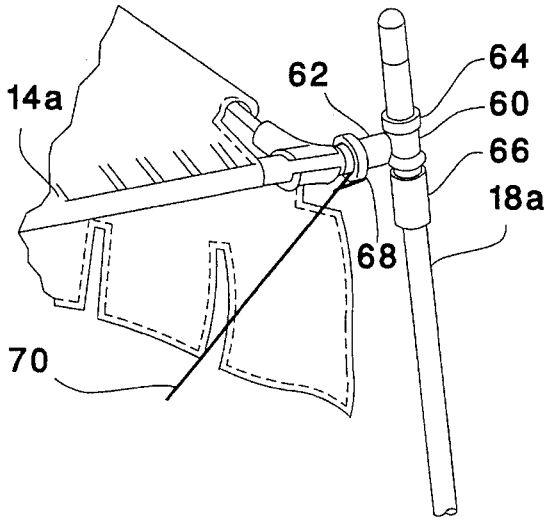
Figure 7
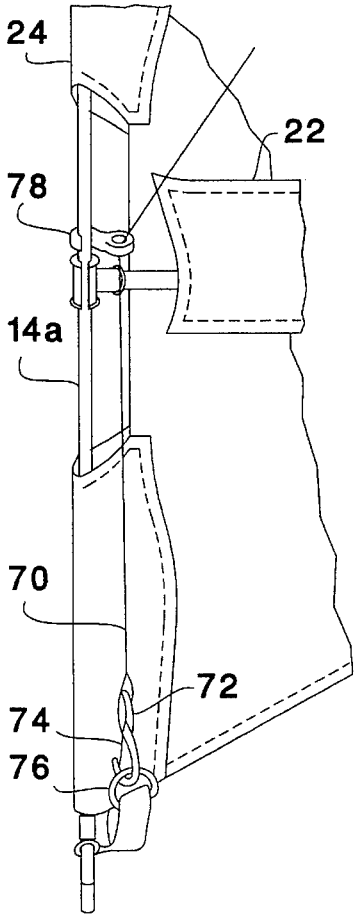
Figure 8

FOLDABLE SHELTER

BACKGROUND OF THE INVENTION

This invention relates to shelters for protection from the sun's rays and more particularly to a shelter which is portable and may be easily assembled and dismantled.

Shelters are known which are composed of a number of rods or tubes which interconnect to form a framework for a canopy. The rods or tubes may be disconnected so that the shelter may be carried by hand. U.S. Pat. Nos. 4,930,534 to Hill, 2,036,033 to Fisher, 2,266,853 to Dabney and 4,739,784 to Fast are examples of such shelters.

Known shelters, such as those described in the above-noted patents, have a number of disadvantages. Some must be anchored to the ground and are not suitable for use on rock or on soil that is too hard for a pin or tent peg to penetrate. Others have no provision for adjustment of the angle of the roof of the shelter to take into account the position of the sun in the sky. If for example the sun is low in the sky, there is no way to adjust the angle of the roof to provide shade to the occupants of the shelter. Only by picking up the entire shelter and turning it so that its back faces the sun will it provide shade to the occupants.

Another shortcoming of many known shelters is that they are composed of a number of parts, many of which are quite small and easy to lose. Moreover because of the large number of parts, the shelters are complicated to assemble.

Another shortcoming of many known shelters is that they have hinges for permitting one part to pivot or rotate relative to another. If such shelters are used on a beach, sand and salt may impair the operation of the hinge.

SUMMARY OF THE INVENTION

The preferred embodiment of the shelter of the subject invention overcomes all of the above disadvantages and shortcomings. Less preferred embodiments overcome some but not all of the above disadvantages or shortcomings. For example in one embodiment of the invention, the shelter of the invention is self-supporting and does not have to be anchored to the ground by pins or pegs nor does it have to be braced by guys to prevent it from collapsing.

Another embodiment of the shelter has a roof whose slope may be adjusted to take into account the angle of the sun in the sky. Thus for example if the shelter is used to shade the occupants from the sun, the angle of the roof may be adjusted as the sun sets to provide continuous shade to the occupants.

A still further embodiment of the shelter has a small number of separate parts. The shelter is easy to assemble and dismantle and may be carried by hand. The shelter may be rolled into a bag which is incorporated into one of the components of the shelter and there are no hinges which are damaged by sand or salt.

In its broadest aspect, the shelter of the invention comprises a canopy and a frame for supporting the canopy. The frame includes a pair of flexible lateral rods; at least two struts removably connected to the lateral rods and adapted to extend therebetween, the struts maintaining the lateral rods in a spaced parallel relationship; a pair of upright poles for maintaining one end of each lateral rod spaced above the ground; and a guy attached to each lateral rod for applying a compressive force thereto with resulting bending of the lateral rod to a generally arcuate shape.

DESCRIPTION OF THE DRAWINGS

The foldable shelter of the invention is described with reference to the accompanying drawings in which:

FIG. 1 is a perspective view of the shelter;

FIG. 2 is plan view of the shelter in a disassembled state;

FIG. 3 is a plan view of the canopy of the shelter folded in two preparatory to stowage in a bag;

FIG. 4 is an elevation of the bag in which the canopy, supporting rods and struts are stowed when not in use;

FIG. 5 illustrates one of the struts, in enlarged scale;

FIG. 6 illustrates the lateral rod and guy, in enlarged scale;

FIG. 7 is a fragmentary perspective view, in enlarged scale, of the connection between the upright pole, the strut and the lateral rod viewed from the front of the shelter;

FIG. 8 is a fragmentary perspective view, in enlarged scale, of the lateral rod, strut and guy.

Like reference characters refer to like parts throughout the description of the drawings.

DESCRIPTION OF THE PREFERRED EMBODIMENT

Figure 9:
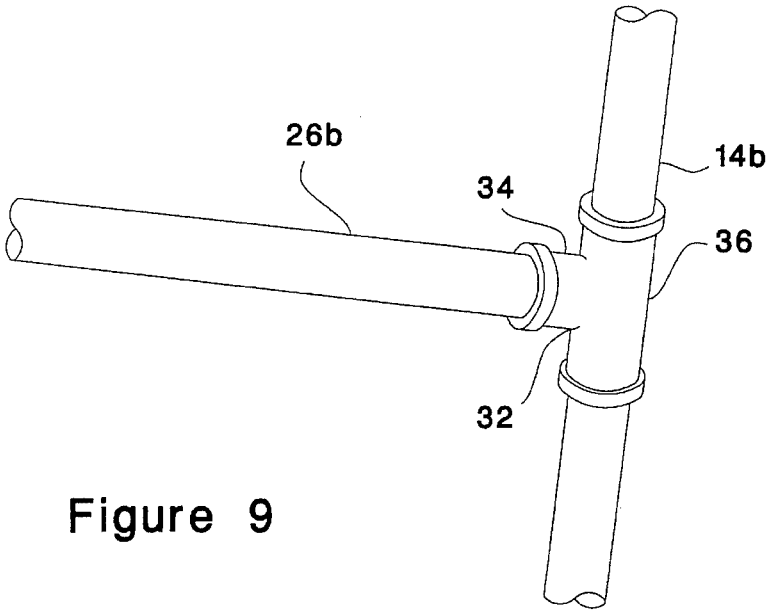
FIGS. 9 and 10 are fragmentary plan and perspective views, respectively, in enlarged scale, of the fastener for connecting a strut to a lateral rod.

With reference to FIG. 1, the foldable shelter of the invention, indicated generally 10, includes a canopy 12 which is supported by a framework made up of a pair of flexible lateral rods 14*a,b*, struts 16*a,b,c* upright poles 18*a,b* and a connecting pole 19. A bag 20 is attached to the lower edge of the canopy.

The struts are parallel to one another and are removably connected to the lateral rods in a manner described below. When so connected the struts maintain the lateral rods in a spaced parallel relationship as illustrated in the Figure. The struts are received in pockets 22 which are stitched to the material of the canopy. Similarly the lateral rods are received in pockets 24. Pockets 22 and 24 are best seen in FIG. 8.

Bag 20 is of conventional construction and has an interior in which the folded canopy, struts and other components of the shelter are accommodated.

The forward end of lateral rod 14*a* is supported by upright pole 18*a*. Similarly the forward end of lateral rod 14*b* is supported by upright pole 18*b*. The rear ends of the two lateral rods rest upon the ground.

With reference to FIGS. 2 and 5, each strut 16 is composed of two tubes 26*a,b* which are interconnected by an elastic cord 28. The cord runs from the hollow interior of one tube to the interior of the other and each of its ends is connected to a separate tube. A sleeve 30 is affixed to the end of tube 26*b* and extends beyond the end of the tube for removable receipt of the adjacent end of tube 26*a*.

The strut is folded when the shelter of the invention is being stored and FIG. 5 illustrates the folded strut where the end of tube 26*a* is outside the sleeve. The two tubes may then be folded toward each other until they are side by side and ready for storage.

When the shelter is assembled for use, the tubes of the strut must be interconnected to form one continuous straight element. To this end, the tubes are aligned but are held apart thereby causing the cord to stretch elastically. The end of tube 26*a* is then inserted into the open end of the sleeve. When the force necessary to separate the tubes is released, the cord contracts thereby drawing the ends toward each other and maintaining the end of tube 26*a* within the sleeve. The longitudinal axes of the two tubes are then aligned.

Figure 10:
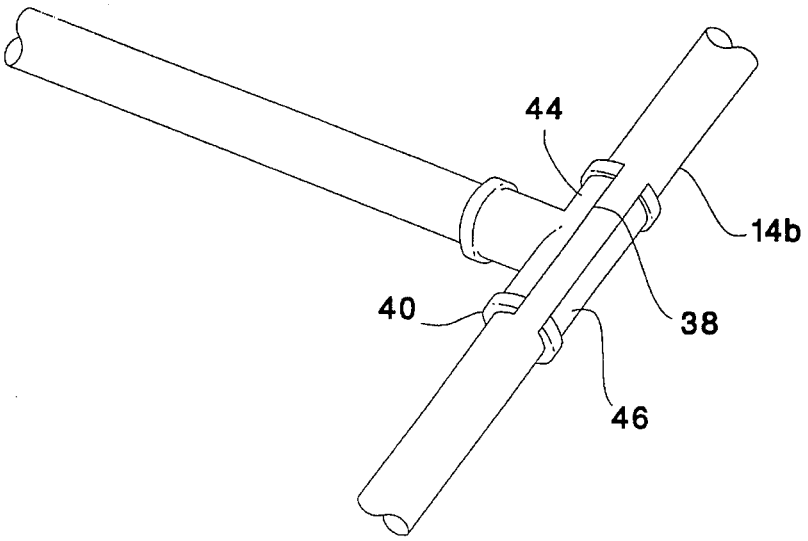

A fastener 32 is attached to the free end of each tube. With reference to FIGS. 9 and 10 the fastener is T shaped and has one sleeve 34 in which the end of the tube 26*b* is received and a second sleeve 36 which is oriented at right angles to the first sleeve. The latter sleeve is split by a length-wise opening 38. The fastener is composed of resilient material such as plastic.

Lateral rod 14*b* is accommodated in the bore 40 of the split sleeve. The rod may be removed from the bore by forcing it against the opening 38 of the sleeve. The pressure of the rod will cause the sleeve to deform resiliently with resulting separation of the two segments 44, 46 of the sleeve. As the segments separate the opening enlarges sufficiently to allow the rod to pass between the two segments and to be removed from the fastener.

The lateral rod 14*b* may be reattached to the fastener by forcing the rod against the exterior faces of two segments of the sleeve to cause the segments to separate sufficiently to allow the rod to pass between the two segments to the interior or bore of the sleeve.

With reference to FIG. 6, the lateral rod is made up of three segments 50*a,b,c* which are interconnected by means of an elastic cord 52 in the same manner as the tubes of the strut. A sleeve 56 is attached to the end of segment 50*c* adjacent to an end of segment 50*b* and a like sleeve 58 is attached to the other end of the segment 50*b*. The sleeves, like sleeve 30 of the strut, are for interconnecting the segments of the lateral rod so that their longitudinal axes are aligned. Like the strut, the segments of the lateral rod may be disconnected as illustrated in FIG. 6 and folded together for storage.

The structure of the upright and connecting poles 18*a,b* and 19 is the same as that of the struts and the lateral rods. The upright and connecting poles are composed of two or more segments each attached by an elastic cord provided with sleeves for allowing the segments of each pole to be joined so that their longitudinal axes are aligned.

With reference to FIG. 7 a fastener 60 is attached to the end of lateral rod 14*a*. The fastener is made up of two sleeves 62,64 which are connected to each other at right angles. Sleeve 62 is permanently affixed to the end of the lateral rod while the upper end of upright rod 18*a* is removably received in the bore of sleeve 64. A stop member 66 is permanently attached to the upright rod and upon which the lower edge of sleeve 64 rests when the lateral rod and upright rod are interconnected as illustrated in FIG. 7. The stop member prevents sleeve 64 from sliding down the upright pole and thereby maintains the lateral rod in the position illustrated in FIG. 1.

A ring 68 is connected to sleeve 62 and a guy 70 is attached to the ring. The guy preferably is a cord of strong material such as nylon or hemp. As illustrated in FIG. 8 a clip 72 having a spring loaded closure 74 is attached to the lower end of the guy and is removably connected to a ring 76 which is attached to the lower end of lateral rod 14*a*. A hook 78 is connected to the guy and is slidable along its length. The hook may be connected to the lateral rod where desired and its position may be adjusted by moving it along the rod.

The guy applies a compressive force on the ends of the lateral rod with a resulting bending of the rod to a generally arcuate shape as illustrated in FIG. 1. The degree of curvature of the rod can be adjusted by changing the position of hook 78. For example the lower the hook on the rod the greater the degree of curvature of the rod.

Assembly of the components of the shelter from the dismantled state illustrated in FIG. 2 involves first removal of the canopy, struts and the other components of the shelter from bag 20. The canopy is then unrolled. When unrolled it is folded in two as illustrated in FIG. 3. The canopy is then unfolded to the position illustrated in FIG. 2. The tubes of each strut are then interconnected so that their longitudinal axes are aligned. The struts are then fed in turn through the openings of pockets 22. The segments of the longitudinal rods are then interconnected in like manner and the rods are fed through pockets 24 on opposite sides of the canopy. The rods are then connected to the struts by means of fasteners 32 and the lower end of each guy is clipped to ring 76. The upright and connecting poles are then interconnected as illustrated in FIG. 1 and the upper ends of the upright poles are fed through sleeve 64. The shelter is then fully assembled, It will be understood of course that modifications can be made in the preferred embodiment illustrated and described herein without departing from the scope and purview of the invention as defined in the appended claims.

What I claim is:

1. A foldable shelter comprising a canopy and a frame for supporting said canopy, said frame including: a pair of flexible lateral rods each having forward and rear ends; at least two struts removably connected to said lateral rods extending therebetween, said struts maintaining said lateral rods in a spaced parallel relationship and being spaced apart from one another, one of which being connected to the forward ends of the lateral rods; a pair of upright poles for maintaining one end of each said lateral rod spaced above the ground; and a guy attached adjacent one end to each said lateral rod at a pair of spaced preselected points along the length thereof, said guy being attached adjacent an opposite end to each of said lateral rods, for applying a force thereto with resulting bending of said lateral rod to a generally arcuate shape, said guys cooperating with said struts and lateral rods so that said frame is self-supporting.

2. The foldable shelter as claimed in claim 1 further including a hook slidable on said guy for interconnecting said guy to said lateral rod at a selected point along the length of said lateral rod.

3. The foldable shelter as claimed in claim 1 wherein each said pole is removably connected to a separate said lateral rod and has a lower end adapted to contact the ground.

4. A foldable shelter comprising a canopy and a frame for supporting said canopy, said frame including: a pair of flexible lateral rods each having forward and rearward ends; at least two struts being spaced apart from one another extending between said lateral rods and maintain said lateral rods in a spaced parallel relationship one of said struts being connected to the forward ends of the lateral rods; a resilient fastener having a split sleeve and attached to an end of each said strut, said fastener having a length-wise opening which, when said lateral rod is forced against it, enlarges sufficiently by resilient deformation of said fastener to receive said rod in the bore of said sleeve and when said rod is therein, said opening contracts as said fastener returns to its undeformed condition thereby maintaining said lateral rod within said bore whereby said lateral rod is interconnected to said strut; and a guy attached adjacent one end to each said lateral rod at a pair of spaced points along the length thereof for applying a force thereto, said guy being attached adjacent an opposite end to each of said lateral rod, with resulting bending of said lateral rod to a generally arcuate shape, said guys cooperating with said struts and lateral rods so that said frame is self-supporting.

5. The foldable shelter as claimed in claim 4 further including a pair of upright poles for maintaining one end of each lateral rod spaced above the ground, each said pole being removably connected to a separate said lateral rod and having a lower end adapted to contact the ground.

6. The foldable shelter as claimed in claim 1, wherein said canopy is provided with sleeves in which said lateral rods and said struts are received such that said canopy is attached to said frame.

* * * * *